US010227681B2

(12) United States Patent
Buckholz

(10) Patent No.: US 10,227,681 B2
(45) Date of Patent: Mar. 12, 2019

(54) HIGH MANGANESE STEEL WITH ENHANCED WEAR AND IMPACT CHARACTERISTICS

(71) Applicant: CATERPILLAR INC., Peoria, IL (US)

(72) Inventor: Samuel August Buckholz, Dunlap, IL (US)

(73) Assignee: Caterpillar Inc., Deerfield, IL (US)

( * ) Notice: Subject to any disclaimer, the term of this patent is extended or adjusted under 35 U.S.C. 154(b) by 219 days.

(21) Appl. No.: 15/271,354

(22) Filed: Sep. 21, 2016

(65) Prior Publication Data

US 2017/0114432 A1 Apr. 27, 2017

Related U.S. Application Data

(60) Provisional application No. 62/244,465, filed on Oct. 21, 2015.

(51) Int. Cl.

| | |
|---|---|
| ***C22C 38/04*** | (2006.01) |
| ***C22C 38/02*** | (2006.01) |
| ***C22C 38/06*** | (2006.01) |
| ***C22C 38/12*** | (2006.01) |
| ***E02F 9/28*** | (2006.01) |
| ***C22C 38/00*** | (2006.01) |

(52) U.S. Cl.

CPC ..... *C22C 38/12* (2013.01); *C22C 38/002* (2013.01); *C22C 38/02* (2013.01); *C22C 38/04* (2013.01); *C22C 38/06* (2013.01); *E02F 9/285* (2013.01)

(58) Field of Classification Search

CPC ..... C22C 38/02; C22C 38/04; C22C 38/06; C22C 38/12; E02F 9/285

USPC ..... 420/72

See application file for complete search history.

(56) References Cited

U.S. PATENT DOCUMENTS

| | | | | |
|---|---|---|---|---|
| 3,201,230 | A | 8/1965 | Mitchell et al. | |
| 3,896,567 | A | 7/1975 | Leoben et al. | |
| 4,113,920 | A | 9/1978 | Helton et al. | |
| 4,342,593 | A | 8/1982 | Larson et al. | |
| 4,531,974 | A * | 7/1985 | Kos | C22C 38/04 420/72 |
| 4,612,067 | A | 9/1986 | Larson et al. | |

(Continued)

FOREIGN PATENT DOCUMENTS

| | | | |
|---|---|---|---|
| CN | 100489140 | C | 5/2009 |
| CN | 102433508 | A | 5/2012 |

(Continued)

OTHER PUBLICATIONS

Buckholz, Samuel A.; "The Influence of Aluminum and Carbon on the Abrasion Resistance of High Manganese Steels"; Thesis for Master of Science in Metallurgical Engineering; 133 pages, 2013.

(Continued)

*Primary Examiner* — Helene Klemanski

(74) *Attorney, Agent, or Firm* — Finnegan, Henderson, Farabow, Garrett & Dunner, LLP

(57) ABSTRACT

A high manganese steel with improved wear and impact characteristics is disclosed. The steel includes a composition comprising, on a weight basis, 25-35 percent manganese, 0-9 percent aluminum, 0.9-2 percent carbon, 0.5-2 percent silicon, 0-1 percent molybdenum, less than 0.03 percent phosphorus, and less than 0.03 percent sulfur, with a balance of iron and incidental impurities.

19 Claims, 2 Drawing Sheets

(56) References Cited

U.S. PATENT DOCUMENTS

| | | | | |
|---|---|---|---|---|
| 4,855,105 | A * | 8/1989 | Svidunovich | C22C 38/04 420/72 |
| 8,900,511 | B2 * | 12/2014 | Ishikawa | C22C 38/02 420/72 |
| 9,650,703 | B2 * | 5/2017 | Lee | C22C 38/002 |
| 2005/0006007 | A1 | 1/2005 | Chao | |
| 2007/0209738 | A1 | 9/2007 | Liu et al. | |
| 2015/0322551 | A1 * | 11/2015 | Lee | C22C 38/04 148/620 |

FOREIGN PATENT DOCUMENTS

| | | | |
|---|---|---|---|
| EP | 692548 | B1 | 3/1999 |
| JP | 1142058 | A | 6/1989 |
| JP | 2310337 | A | 12/1990 |
| JP | 03589797 | B2 | 11/2004 |
| KR | 2010070450 | A | 6/2010 |

OTHER PUBLICATIONS

Diesburg, et al.; "Optimizing Abrasion Resistance and Toughness in Steels and Irons from the Mining Industry"; published in Source Book on Wear Control Technology by American Society of Metals; 1978; 29 pages.

* cited by examiner

HIGH MANGANESE STEEL WITH ENHANCED WEAR AND IMPACT CHARACTERISTICS

TECHNICAL FIELD

The present disclosure is directed to high manganese steel and, more particularly, is directed to high manganese steel with enhanced wear and impact characteristics.

BACKGROUND

Certain machines operate in environments and work with materials that may subject machine components to substantial abrasion. As a result, various components of these machines incur high rates of abrasive wear. Examples of such machines include, mining machines, excavating machines and other machines that move and handle rock, ore, earth, and various abrasive materials associated with mining and excavating. These machines commonly have buckets and/or other implements that break, dig, and handle material. Ground engaging tools (GET) are components that are usually added to buckets and implements in order to enhance their effectiveness. GET generally occupy areas on buckets and other implements that are exposed to the greatest abrasive forces and thus greatest wear. For example, GET may include such components as adapters for tips, cutting edges for buckets, edge protectors for buckets, sidebar protectors for buckets, tips for buckets, shrouds for cutting edges, and variously formed wear members. GET are commonly (but not always) replaceable components that take most of the severe abrasion and wear associated with these buckets and implements.

The materials encountered by the above mentioned machines not only present challenges in terms of abrasion, but also may subject GET to high impact stresses. In addition to being abrasive, material that is engaged by these machines during mining, excavating, or handling operations is not always of uniform consistency and density. Large masses of earth and rock may be encountered and engaged during machine operation, and GET may be subjected to higher strain rates than would occur in working with material of relatively uniform consistency and density. Accordingly, while wear resistance is a desired GET characteristic of major advantage because of the abrasive nature of the material involved, it is not the only desired characteristic. The possibility of encountering material that may place great stress on GET, frequently with sudden impact, makes toughness and the ability to survive high strain rates without breaking additional desirable characteristics.

It would be both beneficial and desirable to provide a steel with a composition that exhibits both high wear resistance and high impact strength and that could be employed in manufacturing GET. It also would be desirable and beneficial that steel with such a composition further increase in strength and wear resistance by tending to wear by deformation rather than by chipping, or removal of material. Such a steel would enable the manufacture of cast GET components with extended life relative to those in the current GET industry, and result in significant savings in cost and maintenance time.

One type of manganese steel purported to increase wear resistance is disclosed in U.S. Pat. No. 4,612,067 that issued on Sep. 16, 1986 to Larson et al. ("the '067 patent"). The '067 patent discloses an austenitic (Hadfield) manganese steel containing about 25% manganese, 1.4% carbon, and 0.1 to 1% silicon, with the balance being essentially iron.

The '067 patent discloses a desire to avoid intentional addition of molybdenum and posits the view that its tendency to be a strong carbide forming element may detract from work hardenability and cause brittle failure. The '067 patent also contemplates aluminum only as a deoxidizer rather than a substantive additional element to the alloy, and essentially characterizes aluminum as an impurity to be avoided.

Although the alloy steel disclosed in the '067 patent may provide improved wear resistance and toughness, still further improvements in manufacturing costs and material characteristics may be possible. In particular, the '067 patent discloses a purposeful omission of molybdenum and does not recognize the advantages of added molybdenum for its desirable characteristics, or that any carbides that may form as a consequence of added molybdenum can be dissolved and dispersed into the austenitic microstructure during reheating of a cast object. In addition, the '067 patent does not recognize that aluminum can be added in an amount sufficient to be consequential to weight reduction without substantially affecting wear resistance and toughness.

The high manganese steel with enhanced wear and impact characteristics of the present disclosure solves one or more of the problems set forth above and/or other problems of the prior art.

SUMMARY

In one aspect, the present disclosure is directed to a high manganese steel with improved wear and impact characteristics. The steel has a composition comprising, on a weight basis, 25-35 weight percent manganese, 0-9 weight percent aluminum, 0.9-2 weight percent carbon, 0.5-2 weight percent silicon, 0-1 weight percent molybdenum, less than 0.03 weight percent phosphorus, and less than 0.03 weight percent sulfur. The steel also may include a balance of iron and incidental impurities.

In another aspect, the present disclosure is directed to a high manganese steel wear member with improved wear and impact characteristics. The steel has a composition comprising, on a weight basis, 25-35 percent manganese, 0-9 percent aluminum, 0.9-2 percent carbon, 0.5-2 percent silicon, 0-1 percent molybdenum, less than 0.03 percent phosphorus, and less than 0.03 percent sulfur. The steel also may include a balance of iron and incidental impurities.

In yet another aspect, the present disclosure is directed to a wear resistant and impact resistant wear member. The wear member includes a cast structure of high manganese steel having an austenitic microstructure. The steel has a composition comprising, on a weight basis, 25-35 percent manganese, 0-9 percent aluminum, 0.9-2 percent carbon, 0.5-2 percent silicon, 0-1 percent molybdenum, less than 0.03 percent phosphorus, and less than 0.03 percent sulfur. The steel also may include a balance of iron and incidental impurities.

DETAILED DESCRIPTION

Figure 1:
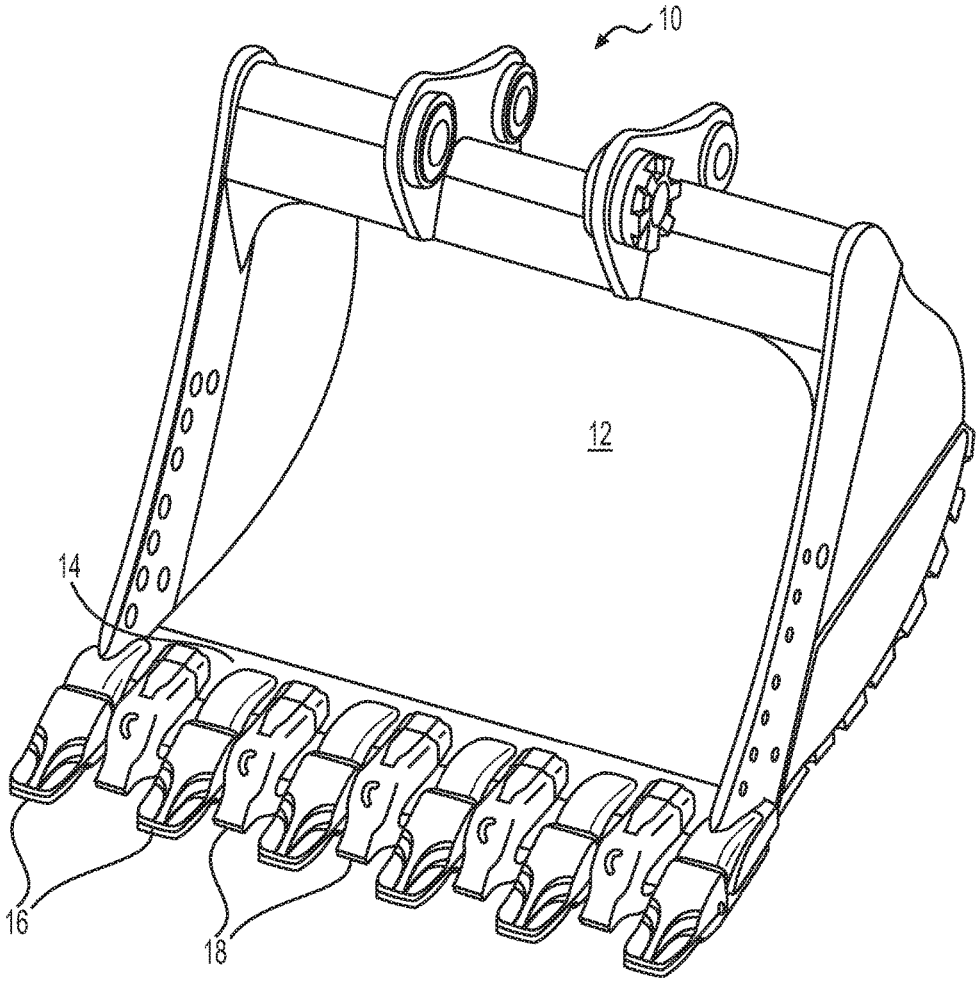
FIG. 1 is an illustration of a bucket provided with exemplary ground engaging tools that may be formed using a high manganese steel according to embodiments of this disclosure.

FIG. 1 illustrates an implement 10 in the form of a bucket 12. Bucket 12 may be of the type employed in various machines such as, for example, a hydraulic shovel, an electric rope shovel, a dragline, a hydraulic excavator, a backhoe, a tracked or wheeled loader, etc. Bucket 12 may include a ground engaging edge 14 and one or more wall members defining a container for material. Ground engaging edge 14 may be provided with a plurality of tooth assemblies 16 (also referred to as tips), and with a plurality of wear members 18 (also referred to as shrouds). For example, a wear member 18 may be provided between each pair of adjacent tooth assemblies 16. Ground engaging edge 14 may be detachable from bucket 12, or it may be a fixed component of bucket 12. Tooth assemblies 16 aid bucket 12 in engaging, digging, and loading material. Tooth assemblies 16 also protect ground engaging edge 14. Wear members 18 protect ground engaging edge 14 between adjacent tooth assemblies 16.

Ground engaging tools (GET), such as tooth assemblies 16 and wear members 18, for example, are particularly subject to wear. GET tend to wear out rapidly and generally require replacement at frequent intervals. Accordingly, the importance of the wear characteristics of steel that is employed to manufacture GET is clear. Given the size and weight of wear members on large machines (some wear members may weigh several hundred pounds), and given the large number of GET in use and needing frequent replacement, even a slight improvement in wear resistance may result in large savings in time, cost, and resources.

In addition to being subject to abrasive working conditions requiring wear resistant steels, GET also are subject to impact stresses. During operation, an implement such as bucket 12 may be working in material with relatively low impact stress on GET, and then suddenly encounter large masses of rock or other material which place substantially higher strain rates on the GET than during normal operation in lower impact material. Also, large rocks may become dislodged during operation and fall with sudden impact on GET. These sudden impact stresses and strain rates may result in fractured and broken wear members. Accordingly, not only should GET possess high wear resistant characteristics, but also they should have strong impact resistance. Insofar as the steels that are employed to form GET, this means that the steels should have a high degree of toughness.

It should be understood that while tooth assemblies 16 and wear members 18 have been illustrated in FIG. 1 as examples of GET that may be manufactured using alloys with compositions in accordance with this disclosure and applied to ground engaging edge 14, it is contemplated that other GET components may be formed with the disclosed alloy compositions. For example, considering the bucket 12 of FIG. 1, GET made with the disclosed alloy compositions may be added to the side edges of bucket 12 and/or to the outside surface of the bucket wrapper. Depending on the type of bucket or other implement and the materials that may be encountered during use, other areas of the bucket or implement that may benefit from GET and wear members made in accordance with this disclosure will become readily apparent to those having ordinary skill in this art. In addition, it is contemplated that the disclosed compositions may be used on motor grader cutting edges and/or end bits, scraper blades, ripper tips, compactor wheel tips, or any other place where wear resistance and toughness are desired.

The choice of composition and microstructure of a steel used to cast a GET often results in a balancing of the ultimate characteristics of the cast steel. For example, where hardness may be sought, aimed at wear resistance, toughness may be compromised, resulting in a wear resistant steel with less than desirable impact resistance. Some common steel compositions employed for GET aim toward a martensitic microstructure and high hardness. However, wear members formed with these compositions lack sufficient wear resistance and toughness. The goal for GET is a cast steel that will have enhanced wear resistance, and also have enhanced impact resistance (toughness) when compared to steels ordinarily employed in manufacturing GET. The compositions under this disclosure may achieve this desired balance.

The alloy employed in accordance with embodiments of this disclosure is a lightweight austenitic steel that is derived from an industry grade steel known as Hadfield's manganese steel, or Hadfield steel. Hadfield steel is comprised of approximately 14 wt. % manganese (Mn) and 1.2 wt. % carbon (C), with the remainder being iron (Fe) and other alloy elements. The disclosed alloy, which for purposes of this disclosure may be referred to as FeMnAlC steel, is austenitic by virtue of its high manganese content. Industry grade steels used in casting GET generally have a Brinell Hardness in the range of 425-525 Brinell Hardness Number (BHN). The FeMnAlC steel under this disclosure has a hardness in the range of approximately 200-275 BHN. In other words, castings of the disclosed FeMnAlC steel are significantly softer than current industry steels, but by the nature of the disclosed composition, are work hardened to achieve enhanced strength during use.

The high manganese steel according to various implementations of this disclosure may have a chemical composition, by weight, as listed in Table 1:

TABLE 1

Composition of alloy steel in weight percent.

| Constituents | Concentration by weight (%) |
|---|---|
| Manganese | 25.00-35.00 |
| Aluminum | 0.00-9.00 |
| Carbon | 0.90-2.00 |
| Silicon | 0.50-2.00 |
| Molybdenum | 0.00-1.00 |
| Phosphorus | <0.03 |
| Sulfur | <0.03 |
| Iron and other residual elements | Balance |

Manganese (Mn) is a low cost element and contributes to deep hardenability. It therefore is present to some extent in most hardenable alloy steel grades. The disclosed alloy steel contains manganese in an amount of at least 25.00% by weight to assure a ductile, austenitic microstructure and contains no more than about 35.00% by weight. This range of manganese helps keep the steel in an austenitic microstructure.

Carbon (C) contributes to the attainable hardness level, as well as the attainable strength. In accordance with various implementations of this disclosure, the carbon content is at least 0.90% by weight to maintain adequate strength and is no more than about 2.00% by weight to assure steel toughness while limiting formation of carbides during slow cooling of a cast component. Carbon gives strength and ductility and, with manganese, drives work hardening.

Aluminum (Al) is present where weight savings is a desirable factor, and may occur in an amount within the range of 0 to 9.00% by weight. Addition of aluminum may result in considerable savings in weight of a given GET while reducing wear resistance only in an acceptable amount. Aluminum at the lower end of the disclosed range may give the greatest wear resistance. Aluminum at the upper end of the disclosed range may give the greatest savings in weight where lower weight is desired while still, by virtue of the overall composition, not adversely affect wear resistance. Aluminum also may be effective in making the composition corrosion resistant. Corrosion resistance may be more evident when present at or near the upper end of the range.

Silicon (Si) in an amount within the range of approximately 0.50 to 2.00 wt. % increases fluidity of the molten steel and helps with castability. Molybdenum (Mo) in an amount up to approximately 1 wt. % enhances strength and toughness. The remainder of the alloy steel composition is essentially iron, except for nonessential or residual amounts of elements which may be present in small amounts. Sulfur (S) and phosphorus (P) are undesirable impurities which may unavoidably be present. However, measures are taken to maintain the level of both sulfur and phosphorus below 0.03 wt. % since both elements tend to lower steel toughness. Other elements generally regarded as incidental impurities may be present within commercially recognized allowable amounts.

Figure 2:
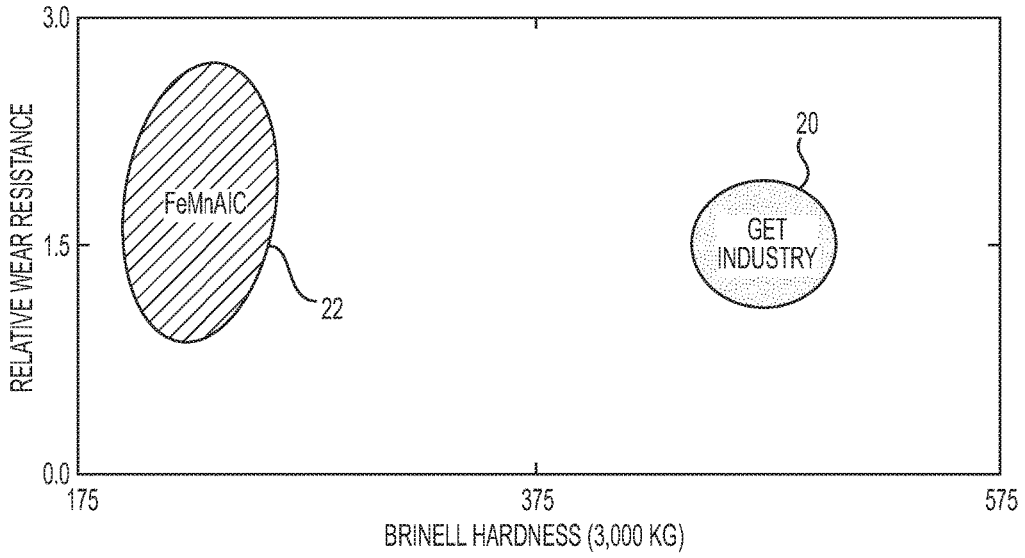
FIG. 2 is a graphical representation comparing wear resistance of current GET industry steels and steel according to disclosed embodiments.

FIG. 2 illustrates a comparison of the wear characteristics of GET components formed using current industry steels with GET components formed using FeMnAlC steels in accordance with this disclosure. One example of a current industry steel used in manufacturing GET is SAE 4130 steel, a steel that includes both low manganese and low carbon content. Hardness is indicated along the x-axis using the Brinell Hardness Number (BHN) at a load of 3000 kg. Wear resistance is indicated along the y-axis. Wear resistance of test samples typically is determined by mass loss of the test sample. Wear resistance is effectively the inverse of mass loss. Accordingly, increasing wear resistance of one sample is indicated by a decrease in mass loss relative to another sample under the same test conditions. The numerical values indicated along the y-axis in the graph of FIG. 2 are numbers chosen to show relative wear resistance. The numerical values have no units since they represent a ratio to a reference material.

Industry steels ordinarily employed in casting GET components will be much harder than FeMnAlC steels after casting. For example, the domain of industry GET steels 20, as indicated in the graph of FIG. 2, may fall between approximately 425 and 525 BHN. On the other hand, the domain of FeMnAlC steels 22 under this disclosure, indicated in the graph, are much softer initially, falling between approximately 200 and 275 BHN when cast and solution treated. The graph of FIG. 2 indicates maximum wear resistance roughly coinciding with 260 BHN for FeMnAlC steels. The noted lower hardness of FeMnAlC steels notwithstanding, and also as shown in FIG. 2, the domain of FeMnAlC steels may exhibit significantly greater wear resistance than current industry steels.

GET wear during use may occur by at least two phenomena known as "cutting" or "plowing." Cutting, or chipping, may be characterized as a removal of material from the GET by being pulled away in the form of chips, resulting in a decrease in mass of the GET. Plowing, or deformation, is a mechanism wherein the material of the GET tends to deform around contacted abrasive particles. As the graph of FIG. 2 indicates, the disclosed FeMnAlC steels are softer than current GET industry steels. As a result, the disclosed FeMnAlC steels wear more readily by plowing rather than by cutting. The surface deformation characteristic of plowing results in work hardening which leaves the surface more resistant to subsequent plowing. This may contribute to the observed increase in wear resistance for the disclosed FeMnAlC steels.

Figure 3:
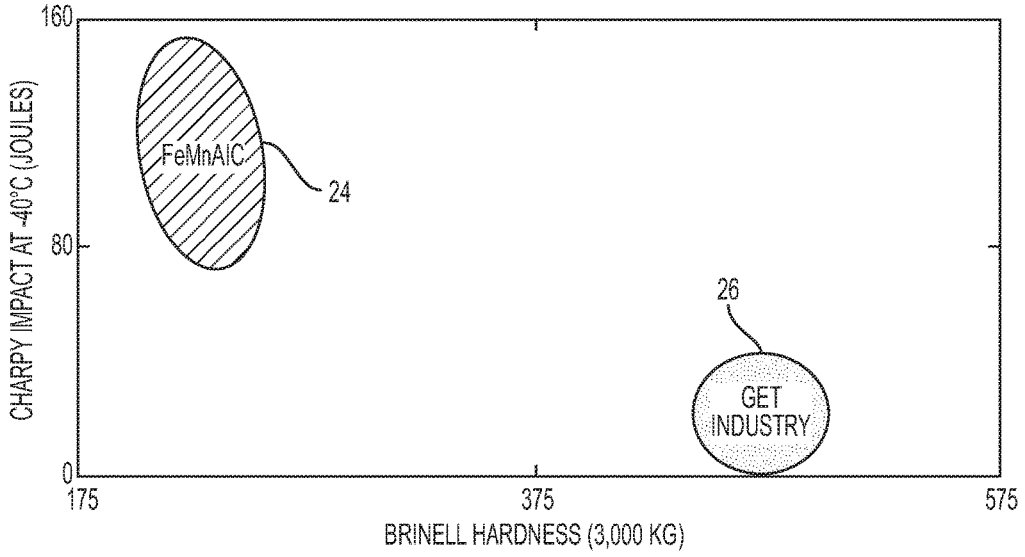
FIG. 3 is a graphical representation comparing impact resistance of current GET industry steels and steel according to disclosed embodiments.

FIG. 3 illustrates a comparison of the toughness characteristics of GET components formed using current industry steels and FeMnAlC steels in accordance with this disclosure. In FIG. 3, and similar to FIG. 2, hardness is indicated along the x-axis using the Brinell Hardness Number (BHN) at a load of 3000 kg. The y-axis in the graph of FIG. 3 designates increasing Charpy impact. The Charpy impact test is a standardized industry test employed to measure material toughness, or impact resistance. The numerical scale along the y-axis in the graph of FIG. 3 refers to joules, which is the unit employed to indicate toughness in the context of the Charpy impact test. As indicated, the test measures toughness at −40° C.

The domain of FeMnAlC steels 24, indicated in the graph of FIG. 3, shows significantly increased toughness when compared to the domain of industry GET steels 26. Specifically, as seen in FIG. 3, toughness for the domain of FeMnAlC steels 24 may range between approximately 70 joules and approximately 150 joules when cast and solution treated. As with the graph of FIG. 2, the graph in FIG. 3 indicates that FeMnAlC steels are significantly softer than current industry steels.

Molten steel may be formulated having a composition according to this disclosure. The molten steel may then be poured into a mold that has been designed to cast a desired GET or other wear member. The GET thus cast may then be allowed to cool. Subsequent to casting and cooling, the GET may be heat treated to a temperature above 1050° C. and held for up to two hours or more. The period of time at which the GET is held above 1050° C. may vary depending on the size (e.g., thickness) of the cast GET. Subsequent to heat treating, the GET is quenched in water. The resulting cast, heat treated, quenched GET has an austenitic microstructure by virtue of the high manganese content of the steel.

During slow cooling of the molten steel to form the cast GET, various types of inclusions and undesirable microstructures may tend to form. The inclusions may predominately include carbides, and the undesirable microstructures may predominately be alpha iron ferrite. Such inclusions and microstructures may be areas of weakness in the cast steel where they form at grain boundaries of the austenitic microstructure. Heat treating above 1050° C. substantially eliminates these inclusions and microstructures. This heat treating to substantially eliminate inclusions and microstructures is referred to as solution treatment. During solution treatment, the inclusions and microstructures are dissolved and dispersed into the austenite microstructure of the cast GET. The cast GET based on the disclosed composition is much softer than the steel currently being used for casting GET.

INDUSTRIAL APPLICABILITY

The disclosed high manganese steel with enhanced wear and impact characteristics is particularly useful for forming cast steel GET, including such components as adapters, cutting edges, edge protectors, sidebar protectors, tips, shrouds, and variously formed wear protectors and other wear members that are employed on buckets and other implements of excavating, grading, cutting, and mining machines, and other machines that may work in abrasive environments. In addition, the disclosed steel compositions may be used in the manufacture of any cast or forged steel product where both wear resistance and impact resistance are desirable characteristics. The steel of the present disclosure may reduce costs by enhancing wear resistance and thereby extending the life of GET manufactured with the disclosed steel compositions. The impact resistance of the disclosed steel compositions may result in even further savings in costs due to reduced failure of GET under impact loads. Cast GET made with steel according to the disclosed compositions may exceed wear resistance and impact resistance of other cast GET made with current GET industry steels.

The disclosed high manganese steel with enhanced wear and impact characteristics is a lightweight austenitic steel that may include varying amounts of aluminum within the disclosed range. Its lightweight characteristic may be enhanced by including aluminum toward the upper end of the disclosed range. The lightweight characteristic of the disclosed steel enables casting of lighter GET than with current GET industry steels. As a result, a bucket or other machine implement may be considerably lighter than would otherwise be possible with the same size GET. This may enhance machine performance, both in terms of maneuverability and fuel economy.

Cast wear members made in accordance with embodiments of the disclosure are austenitic by virtue of the high manganese amounts in the steel composition. Undesirable inclusions, such as carbides, and undesirable microstructures, such as alpha iron ferrite, may form during slow cooling of a cast GET and, unless substantially eliminated, may result in weakness in the castings along which failure of the resulting GET. Ferrites and carbides may be eliminated by solution treatment. This includes heat treating the steel casting to above 1050° C. and holding for a predetermined period of time. The inclusions may be dissolved into the austenite microstructure and leave a steel casting that is both wear resistant and impact resistant.

The composition of GET industry steels generally achieve hardness based on their martensitic microstructure. While hardness is achieved, a relative degree of brittleness also results. In order to soften the resulting steels and reduce brittleness, the steels are tempered for a period of time. Steels of the disclosed composition do not require tempering in order to achieve their wear resistance and toughness. This results in time savings and further cost savings over GET industry steels to achieve an enhanced GET.

It will be apparent to those skilled in the art that various modifications and variations can be made in the disclosed high manganese steel with enhanced wear and impact characteristics without departing from the scope of the disclosure. Other embodiments of the disclosed high manganese steel with enhanced wear and impact characteristics will be apparent to those skilled in the art from consideration of the specification. It is intended that the specification and examples be considered as exemplary only, with a true scope of the disclosure being indicated by the following claims and their equivalents.

What is claimed is:

1. A high manganese steel with improved wear and impact characteristics, comprising:

steel having a composition comprising, on a weight basis:

Mn: 25-35 wt. %,

Al: 0.10-5.0 wt. %,

C: 0.9-2 wt. %,

Si: 0.5-2 wt. %,

Mo: 0.10-1.0 wt. %,

P: <0.03 wt. %,

S: <0.03 wt. %, and a balance of Fe and incidental impurities.

2. The high manganese steel according to claim 1, wherein the steel, when cast and solution treated, has a Brinell Hardness Number between approximately 200 and 275 at a 3000 kg test load.

3. The high manganese steel according to claim 2, wherein the steel, when cast and solution treated, has a Brinell Hardness Number of approximately 260 at a 3000 kg test load.

4. The high manganese steel according to claim 1, wherein the steel, when cast and solution treated, has a toughness as measured by the Charpy Impact Test of between approximately 70 and approximately 150 joules.

5. The high manganese steel according to claim 4, wherein the steel, when cast and solution treated, has a toughness as measured by the Charpy Impact Test of approximately 150 joules.

6. The high manganese steel according to claim 1, wherein the composition of the steel is selected such that cooling of a steel component cast from the steel results in a microstructure throughout the entire steel component that is predominately an austenitic microstructure.

7. The high manganese steel according to claim 1, wherein carbides and ferrite microstructure formed during cooling of a steel component cast from the steel are substantially eliminated by heat treating the steel component to a temperature above 1050° C.

8. The high manganese steel according to claim 7, wherein, subsequent to heat treating, the steel component is quenched in water.

9. A high manganese steel wear member, the steel having a composition comprising, on a weight basis:

Mn: 25-35 wt. %,

Al: 0.10-5.0 wt. %,

C: 0.9-2 wt. %,

Si: 0.5-2 wt. %,

Mo: 0.10-1.0 wt. %,

P: <0.03 wt. %,

S: <0.03 wt. %, and a balance of Fe and incidental impurities.

10. The high manganese steel wear member of claim 9, wherein the microstructure of the steel is predominately an austenitic microstructure throughout the entire wear member.

11. The high manganese steel wear member of claim 9, wherein the wear member has a Brinell Hardness Number between approximately 200 and 275 at 3000 kg test load, and has a toughness as measured by the Charpy Impact Test of between approximately 70 and approximately 150 joules.

12. The high manganese steel wear member of claim 9, wherein the wear member is one of a cutting edge for a motor grader, an end bit for a motor grader, a scraper blade, a ripper tip, a compactor wheel tip, an adapter for a tip, a cutting edge for a bucket, an edge protector for a bucket, a sidebar protector for a bucket, a tip for a bucket, and a shroud for a cutting edge.

13. The high manganese steel wear member of claim 9, wherein the amount of manganese in the composition is approximately 35% by weight.

14. A wear resistant and impact resistant wear member, comprising:

a cast structure of high manganese steel having an austenitic microstructure, wherein the steel has a composition comprising, on a weight basis:

Mn: 25-35 wt. %,

Al: 0.10-5.0 wt. %,

C: 0.9-2 wt. %,

Si: 0.5-2 wt. %,

Mo: 0.10-1.0 wt. %,

P: <0.03 wt. %,

S: <0.03 wt. %, and a balance of Fe and incidental impurities.

15. The wear resistant and impact resistant wear member of claim 14, wherein the cast structure is heat treated to substantially eliminate inclusions and non-austenitic microstructures formed during cooling of the cast structure.

16. The wear resistant and impact resistant wear member of claim 15, wherein the inclusions include carbides and the non-austenitic microstructures include alpha ferrite that are substantially eliminated by being dissolved into the austenitic microstructure.

17. The wear resistant and impact resistant wear member of claim 16, wherein the cast structure is heat treated to a temperature above 1050° C. and quenched in water after being heat treated.

18. The wear resistant and impact resistant wear member of claim 14, wherein the amount of manganese in the composition is approximately 30% by weight, the amount of aluminum in the composition is approximately 5% by weight, and the amount of carbon in the composition is approximately 1.5% by weight.

19. The wear resistant and impact resistant wear member of claim 14, wherein the surface of the wear member has a Brinell Hardness Number between approximately 200 and 275.

* * * * *